United States Patent [19]

Warwick

[11] Patent Number: 4,796,384

[45] Date of Patent: Jan. 10, 1989

[54] ADAPTABLE SECURITY GRILLE AND LATCHING MECHANISM

[76] Inventor: David R. Warwick, 51 Silverwood Dr., Lafayette, Calif. 94549

[21] Appl. No.: 136,704

[22] Filed: Dec. 21, 1987

[51] Int. Cl.[4] ..... E06B 3/68

[52] U.S. Cl. ..... 49/55; 49/56; 49/141; 49/395; 292/302

[58] Field of Search ..... 49/55, 56, 50, 141, 49/395, 394; 292/302

[56] References Cited

U.S. PATENT DOCUMENTS

| | | | |
|---|---|---|---|
| 1,118,560 | 11/1914 | Lange . | |
| 1,337,513 | 4/1920 | Haldeman . | |
| 1,873,229 | 8/1932 | Van Dresser . | |
| 2,468,683 | 4/1949 | Michal | 292/302 X |
| 2,478,434 | 8/1949 | Swanson | 70/70 |
| 2,641,494 | 9/1949 | Burris | 292/189 |
| 2,878,389 | 3/1959 | Raffman | 250/68 |
| 3,738,062 | 6/1973 | Ughi | 49/55 |
| 3,953,064 | 4/1976 | McHenry | 292/184 |
| 4,162,590 | 7/1979 | Earley | 49/55 |
| 4,258,504 | 3/1981 | Hicks | 49/56 |
| 4,263,747 | 4/1981 | Coltrin et al. | 49/56 |
| 4,400,911 | 8/1983 | Bell et al. | 49/55 |
| 4,465,262 | 8/1984 | Itri et al. | 256/24 |
| 4,475,309 | 10/1984 | Porter | 49/55 |
| 4,631,862 | 12/1986 | Gallardo | 49/56 |
| 4,671,012 | 6/1987 | Merklinger et al. | 49/55 |

*Primary Examiner*—Philip C. Kannan

*Attorney, Agent, or Firm*—Harris Zimmerman; Howard Cohen

[57] ABSTRACT

A security grille for disposition at a window, door or the like has at least a pair of vertically spaced tubular cross bars and a vertically extending tubular side member through which the grille may be fastened to a wall. Horizontal legs of a pair of angle members telescope into the ends of the cross bars while vertical legs of the angle members telescope into opposite ends of the side member. The construction enables horizontal expansion and contraction to accommodate to different installations, enables use of the side member with grilles having different cross bar spacings in the vertical direction and enables variation of the location of the attachment of the grille to the wall without displacement of the remainder of the grille. In the preferred form, the side member is fastened to the wall by latch mechanism having an enclosed cam which normally engages a pin on the side member but which can be actuated to release the pin and open the grille with a single movement of an actuator lever.

6 Claims, 4 Drawing Sheets

ADAPTABLE SECURITY GRILLE AND LATCHING MECHANISM

TECHNICAL FIELD

This invention relates to barriers for preventing entry of intruders through windows, doors or other openings in a structure. More particularly the invention relates to grillworks for disposition at a window, door or the like and to latching mechanism for enabling opening of the grille by persons inside a building.

BACKGROUND OF THE INVENTION

Grilles formed of metal or other strong material are a well known device for inhibiting unauthorized entry of persons through openings in a building. Prior grille constructions are highly effective for this purpose but are also subject to several practical problems.

Prior grilles are usually designed for use with a door or window having specific dimensions and are not readily adaptable to openings of differing size. This makes it necessary to manufacture and stock such grilles in a large number of different sizes or to custom make grilles for each installation, either of which adds to the costs of such devices.

Prior grilles of fixed dimensions also require that fastening devices such as bolts or screws be located at specific positions that are dictated by the configuration of the grille. This can cause installation difficulties if there ar pre-existing obstructions, such as light switches, an adjoining window or the like, at those locations.

Efforts have heretofore been made to provide a grille which is expansible or contractable to accommodate to different sized windows or doors but the degree of adaptability tends to be limited and the constructions are complex and costly.

Under many circumstances, the grille should be fastened to the wall by latching mechanism which enables opening of the grille by persons inside the building. This is necessary for obvious reasons in the case of a door grille and is also desirable, for safety reasons, in the case of window grilles as windows may under some circumstances provide an alternative escape route in emergencies such as during a fire.

The latches of prior grilles tend to be complicated and costly and may be difficult to install. Release of such latches and opening of the grille typically require a series of manipulations whereas it would be advantageous if the operator could both unlatch and open the grille with a single motion of a control lever or the like. The latching components of prior grilles are also often undesirably accessible from the exterior of the building, by breaking of a window for example, and thus may tend to defeat the purpose of the grille.

Prior grille latches are also typically designed for use in a grille that is mounted inside the window or door which is to be protected. It would be advantageous if a single latching mechanism were compatible with both inside mounted grilles and grilles that are mounted on the outside of the building.

The present invention is directed to overcoming one or more of the problems discussed above.

SUMMARY OF THE INVENTION

In one aspect, the present invention provides a security grille for disposition at a window, door or the like, the grille having first and second cross bars which extend in a horizontal direction and which are vertically spaced apart with the first cross bar being above the second cross bar. Each cross bar has a first end portion, adjacent a first side region of the grille, that has a hollow tubular configuration defining an internal passage in the cross bar. A vertically extending side member is situated at the first side region of the grille, the side member also having a hollow tubular configuration at least at the upper and lower portions of the side member and means are provided for fastening the side member to a wall or the like. First and second angle members each have a horizontally extending leg and a vertically extending leg, the horizontal legs of the first and second angle members being entered into the first end portions of the first and second cross bars respectively in telescoping relationship with the cross bars. The vertical legs of the first and second angle members are entered into the upper and lower portions of the side member in telescoping relationship with the side member.

In another aspect of the invention, the means for fastening the side member to a wall or the like includes at least one latching pin secured to the side member. A vertically extending hollow housing is attached to the wall and has a vertical interior passage and a transverse slot which communicates with the passage and which is proportioned to receive the latching pin. A cam is disposed within the housing passage for movement between first and second positions, the cam having a notch through which the latching pin extends when the pin is in the slot of the housing. The notch is defined in part by a first cam surface which extends vertically to hold the pin in the housing slot when the cam is at its first position and which is withdrawn from the slot to release the pin when the cam is at its second position. The notch is further defined in part by a second cam surface proportioned and positioned to eject the pin from the slot as the cam is traveled from its first position to its second position. The cam surface is still further defined in part by a third cam surface which forms an inclined ramp extending into the housing slot in position to be urged downward by the latching pin as the pin enters the slot. Resilient means bias the cam towards its first position.

In another aspect of the invention, a manually operable grille release element is disposed inside the building in which the window, door or the like is located in spaced apart relationship from the window, door or the like and the other components of the grille. The release element is coupled to the cam by means for shifting the cam from its first position to its second position in response to operation of the grille release element.

In still another aspect, the invention provides a latching mechanism for engaging and holding a pin like element and for selectively releasing and ejecting the pin like element, the mechanism having a housing with an interior passage and having a transverse pin receiving notch which intersects the passage. A cam member is disposed within the housing passage for movement between first and second positions, the cam member having a notch through which the pin extends when it is in the pin receiving slot of the housing. The notch is defined in part by a first cam surface located to hold the pin in the slot when the cam is at its first position and to release the pin when the cam is moved to its second position. The notch is further defined in part by a second cam surface proportioned and positioned to eject the pin from the slot as the cam is traveled from the first position to the second position. The notch is still further defined in part by a third cam surface which extends into the slot when the cam is at its first position and which is inclined relative to the path of entry of the pin into the slot to cause temporary movement of the cam from its first position to its second position as the pin enters the slot. A spring is disposed within the housing for biasing the cam towards its first position and an actuator element extends into the housing and is coupled to the cam for selectively shifting the cam to its second position to cause release and ejection of the pin.

The invention provides a security grille construction which can be adjusted to accommodate to varying conditions at the installation site. The grille is expansible or contractable to facilitate installation at windows or doors of different width. Mounting components for fastening the grille to a wall can be shifted in both the horizontal and vertical directions, without dislocation of the remainder of the grille, to avoid obstacles which might be present at a particular wall in the vicinity of a window or door. The mounting components of a particular size can also be embodied in grilles that have different cross bar spacings. In the preferred form of the invention, the mounting components include latching mechanism which automatically engages the grille when it is closed and which releases and opens the grille in response to a single motion pivoting of a latch control lever which may be at a location away from the window or door which is protected by the grille. The latching mechanism is adaptable to outside mounting of the grille as well as inside mounted grilles.

The invention, together with further objects and advantages thereof, may be further understood by reference to the following detailed description of preferred embodiments and by reference to the accompanying drawings.

DETAILED DESCRIPTION OF THE PREFERRED EMBODIMENTS

Figure 1:
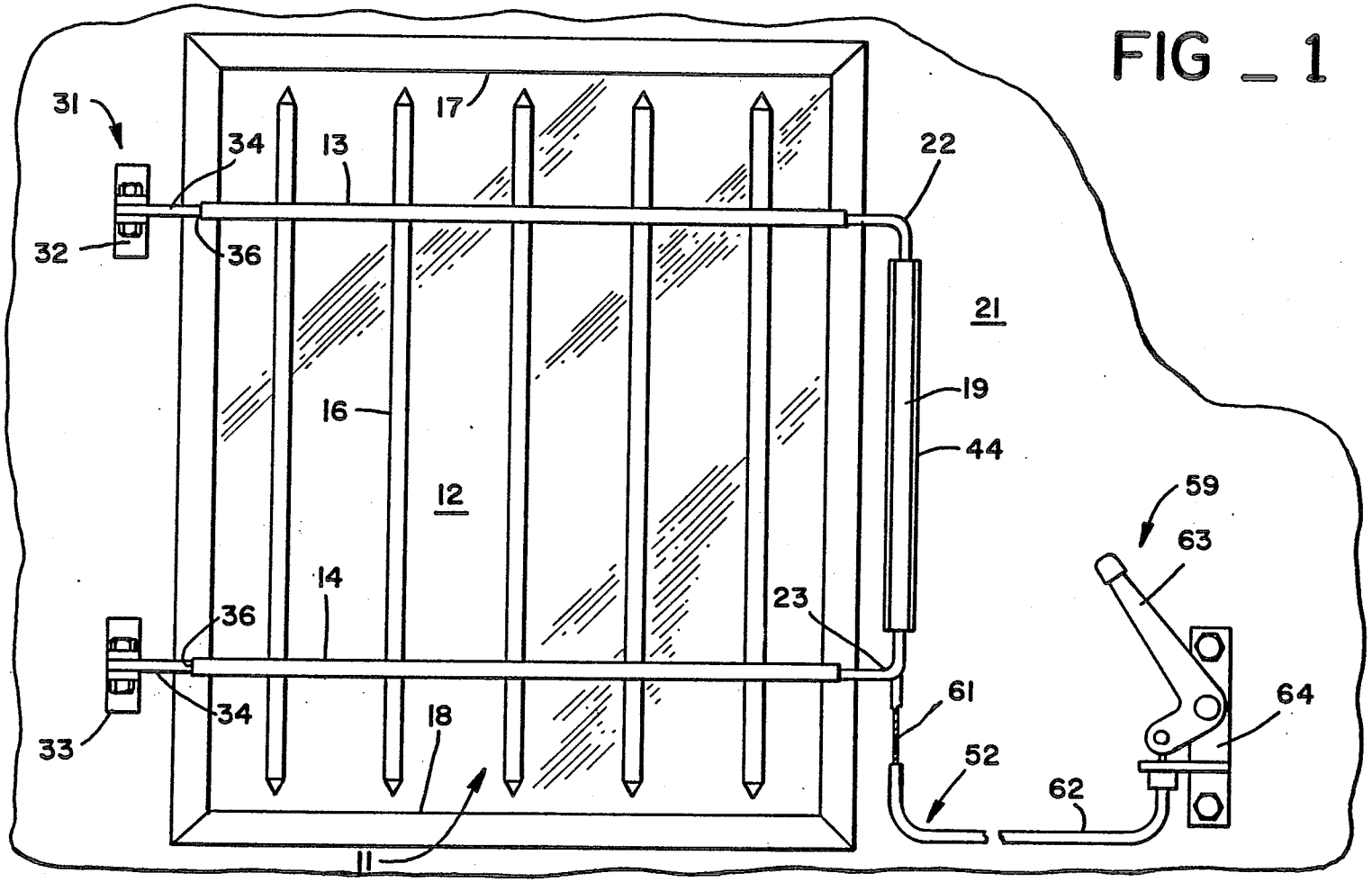
FIG. 1 is a frontal elevation view of a preferred embodiment of the invention shown installed at the inside of a typical building window.

Referring initially to FIG. 1 of the drawings, a security grille 11 embodying the invention is shown installed at a typical building window 12, the grille being at the inside surface of the window in this example although it may also be mounted at the exterior of the building if desired.

The grille 11 of this particular example has upper and lower cross bar members 13 and 14 which extend horizontally and which are vertically spaced apart. A plurality of spaced apart vertical bars 16 span the cross bars 13 and 14 and extend a distance above and below the cross bars into proximity with the upper and lower frame members 17 and 18 respectively of the window 12. The cross bars 13 and 14 and vertical bars 16 are secured to each other such as by welding in the case of a metal grille 11. It should be recognized that the invention is applicable to grilles 11 having differing numbers of cross bars 13, 14 and/or vertical bars 16 and to grilles having curved members which are sometimes used to provide a decorative design.

At least the end portions of cross bars 13 and 14 are of hollow tubular construction for purposes which will be hereinafter described and, as a practical matter, the cross bars of this example are tubular throughout their length and are of rectangular cross section.

Figure 2:
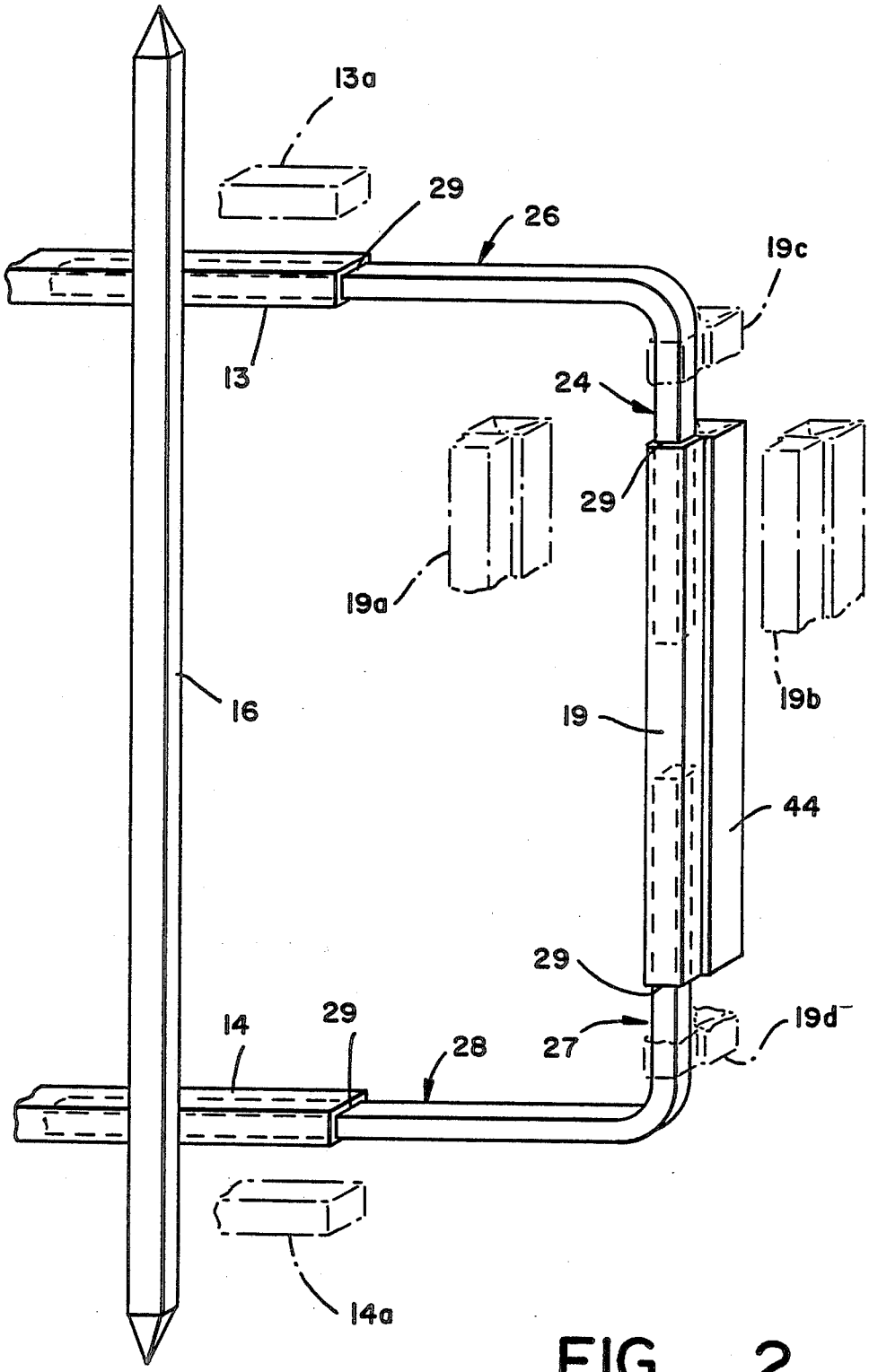
FIG. 2 is a perspective view of the right side region of the grille of FIG. 1 shown prior to installation at the building wall.

The right side of the security grille 11 includes a vertically extending side member 19 through which the grille is fastened to the building wall 21 at that side of window 12. Referring now to FIG. 2, side member 19 has a length which is smaller than the spacing of upper and lower cross bars 13 and 14 and is coupled to the cross bars through upper and lower angle members 22 and 23 respectively.

In particular, side member 19 has a hollow tubular construction of rectangular cross section similar to that of the cross bars 13 and 14. Upper angle member 22 has a vertical leg 24 which is entered into the upper end of side member 19 in telescoping relationship and has a horizontal leg 26 which extends into the adjacent end of upper cross bar 13 in telescoping relationship. Similarly, the lower angle member 23 has a vertical leg 27 entered into the lower end of side member 19 and a horizontal leg 28 entered into the adjacent end of lower cross bar 14.

The grille mounting structure defined by side member 19 and angle members 22 and 23 imparts several forms of adjustability to the grille that greatly facilitate the manufacture, distribution and installation of grilles. A unitary set of cross bars 13, 14 and vertical bars 16 can, for example, be adapted to windows of different width by moving the side member 19 closer to the cross bars as illustrated at **19*a* or further away from the cross bars as illustrated at 19*b*. The side member 19 may be shifted upwardly or downwardly without changing the location of the cross bars 13, 14 and angle members 22, 23, as illustrated at 19*c* and 19*d*, if wall fixtures or other structure make attachment difficult when the side member is at a centered position relative to the cross bars. The side member 19 and angle members 22 and 23 need not be manufactured in different sizes in order to accommodate to grilles 11 having different cross bar spacing as illustrated at 13*a* and 14*a*. The angle members 22 and 23 may simply be partially withdrawn from side member 19** or telescoped further into the side member to adapt to different cross bar spacings.

The capability of shifting the location of the side member 19 relative to the cross bars 13, 14 and vertical bars 16 is normally no longer needed once the grille 11 has been adapted to a specific installation site. Once that has been accomplished, the entire structure may be unitized by forming welds 29 at the junctures between the cross bars 13, 14 and angle member legs 26 and 28 and at the junctures between side member 19 and angle member legs 24 and 27.

Referring again to FIG. 1, the side member 19 may be directly secured to wall 21 with screws, bolts or the like in instances where the grille 11 is to be non-openable. Under that condition, the left hand side of the grille may be similarly secured to the wall 21 with another similar side member 19 and angle members 22 and 23. This embodiment is not of that form as it is designed to be openable by persons situated inside the wall 21.

In this embodiment the left side of the grille 11 is hinged to wall 21 preferably by means 31 which enables further adjustability during installation. In particular, upper and lower hinges 32 and 33 respectively are secured to wall 21 and rods 34, of rectangular cross section, extend from the hinges into the adjacent ends of cross bars 13 and 14 in telescoping relationship. After the rods 34 have been shifted axially relative to the cross bars 13, 14 to adapt the grille to the particular installation, welds 36 are formed at the junctures between such components to unitize the grille 11.

Figure 3:
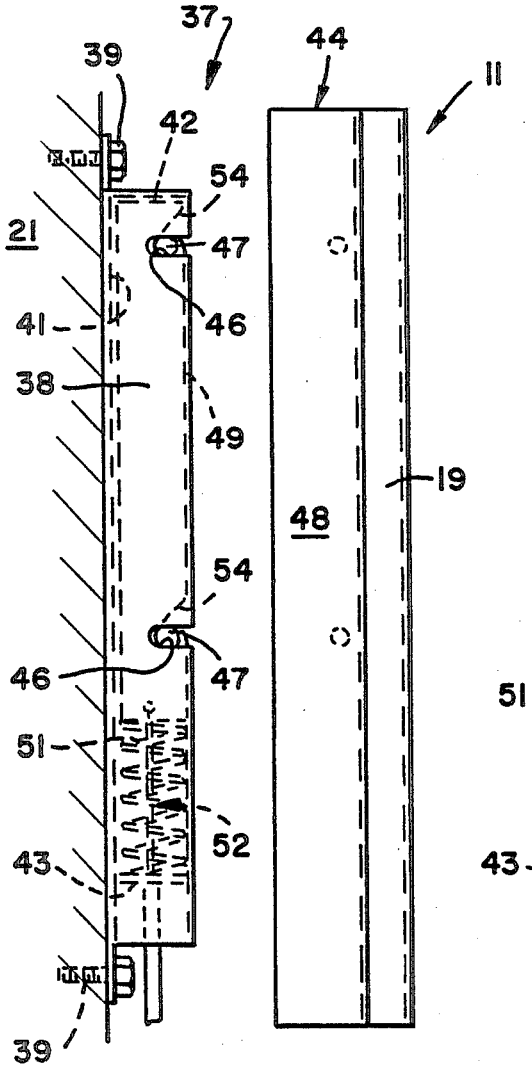
FIG. 3 is a side elevation view of components of latching mechanism which may be included in the grille to enable a quick and easy release and opening of the grille by persons inside the building, the latching components being shown in the disengaged condition.
Figure 4:
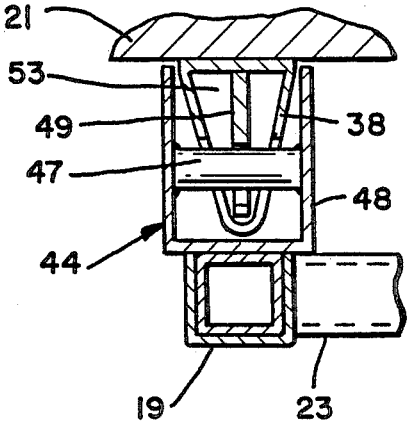
FIG. 4 is a plan section view of the latching components shown in the engaged condition.

Referring jointly to FIGS. 3 and 4, side member 19 is releasably fastened to wall 21 through latching mechanism 37 which is of an advantageous form that securely anchors the grille in its closed condition while enabling persons inside the wall 21 to disengage and open the grille quickly and easily with a single hand motion.

Components of the latching mechanism 37 include a linear, vertically extending housing 38 secured to wall 21 by strong lag bolts 39 or the like at a location which is behind the grille side member 19 when the grille is at the closed position. The housing 38 has a vertical interior passage 41 closed at the upper end by a top member 42 and closed near the lower end by a shelf 43.

The grille side member 19 is secured by welding or the like to a slightly broader vertical channel member 44 proportioned to receive and cover the housing 38 when the grille 11 is in the closed position. To facilitate mating of the channel member 44 and housing 38 as the grille is being closed, the housing has a triangular cross section with the base being against wall 21.

Figure 5:
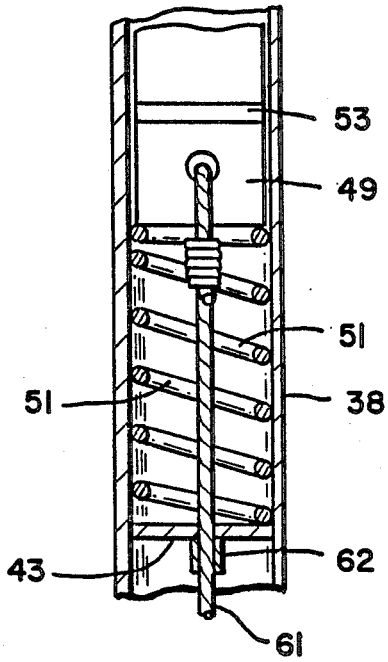
FIG. 5 is a vertical section view of a lower region of the latching mechanism.

The interior passage of housing 38 is intersected by a pair of vertically spaced apart transverse slots 46 in the housing wall. Each such slot 46 is located to be entered by one of a pair of latching pins 47 which extend transversely within channel member 44 and which are secured to the opposite walls 48 of the channel member. Pins 47 are engaged, when the grille is latched closed, by a linear cam member 49 disposed within housing passage 41 and which is slidable within the passage between first and second positions. At the first position, cam 49 abuts the top closure 42 of the housing 38 and a compression spring 51, situated between the lower end of the cam and shelf 43, biases the cam towards the first position. An actuator cable 52 may be used to pull the cam 49 downward against the force of spring 51 to the second cam position as will hereinafter be described in more detail. Referring now to FIGS. 4 and 5 in combination, triangular wings 53 extending outward from cam 49 jointly have a triangular outline conforming to the cross section of passage 41 and serve to keep the cam centered in the passage.

Referring again to FIG. 3, cam 49 has a pair of notches 54 in the forward edge of the cam each such notch being at the region of a separate one of the housing slots 46 when the cam is at the above described first position. Thus the notches 54 are located to receive the latching pins 47 of the grille 11.

Figure 6:
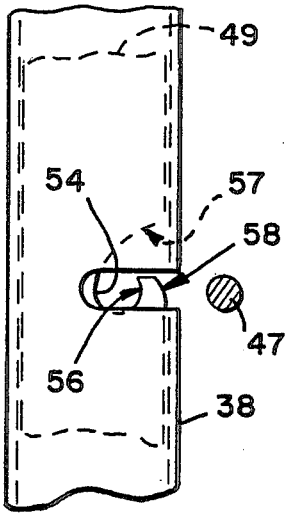
FIGS. 6 to 8 are side elevation views of a portion of the latching mechanism illustrating successive stages in the engaging and disengaging of the mechanism.
Figure 7:
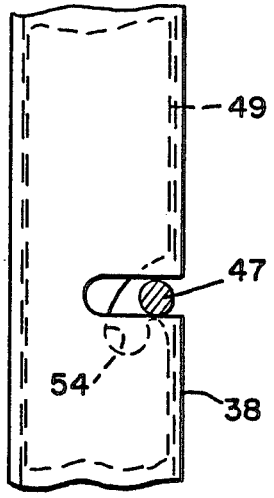
Figure 8:
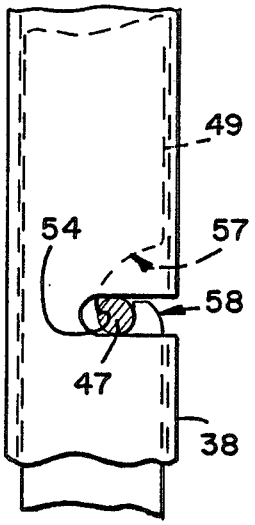

Referring jointly to FIGS. 6, 7 and 8, the boundary of each notch 54 is defined by three cam surfaces 56, 57 and 58. The first cam surface 56 extends upward within housing slot 46, when the cam 49 is at its first position, in front of the latching pin 47 when the pin is in the slot and thus functions to prevent release of the pin as long as the cam remains at that position.

The second cam surface 57 extends upwardly and forwardly from the back of the notch 54 and thus functions to eject pin 47 when the cam 49 including the first cam surface 56 is forced downward to its second position. Forcible ejection of the pin 47 in this manner simultaneously unlatches the grille and imparts an opening motion to the grille.

The third cam surface 58 extends upward and backward within the forward region of housing slot 46 when the cam 49 is at its first position. Thus the third cm surface 58 forms a ramp which is forced downward as the latching pin 47 enters the housing slot 46. This momentarily shifts the cam 49 downward to its second position after which spring force restores the cam to its first position at which the pin 47 is held in the slot and the grille is latched at the closed position.

Referring again to FIG. 1, it may be seen that the channel member 44 of the grille 11 completely covers the above described latching mechanism when the grille is in its closed position. This prevents opening of the grille 11 by an intruder who is outside the wall 21 but who may have broken the glass of window 12 and be reaching in through the grille.

The objective of forestalling intrusion is further served by the construction of the latching mechanism control 59 which enables persons inside the room to release and open the grille. In particular, the actuator cable 52 is of the type which has a wire 61 extending within metal sheathing 62 that is also somewhat flexible but which is not extensible or contractable along its axis. The actuator cable 52 has a length of at least three and one half feet and is preferably somewhat longer. Thus a control lever 63 or the like for operating the latching mechanism may be fastened to wall 21 at a location which is beyond the reach of someone who is on the other side of the grille 11.

The control lever 63 of this example pivots on a bracket 64 secured to wall 21 and is coupled to the wire 61 of cable 52. The sheathing 62 of cable 52 is secured to bracket 64 and thus pivoting of the lever shifts the wire 61 axially relative to the sheathing. Referring again to FIG. 5, the opposite end of sheathing 62 is secured to shelf 43 within latching mechanism housing 38 while the wire 61 extends upward and is coupled to the lower end of cam 49. Thus axial movement of the wire 61, relative to sheathing 62, in the downward direction, shifts the cam 49 to its second position to effect the hereinbefore described release and opening of the grille.

Figure 9:
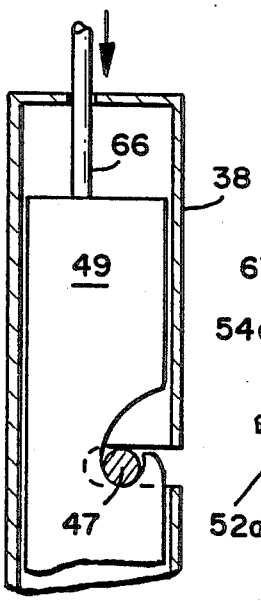
FIG. 9 is a side elevation section view of an upper portion of a modified form of the latching mechanism.

The latching mechanism control may take other forms if desired. Referring to FIG. 9, the actuator cable 52 may, for example, be replaced with a rigid rod 66 which extends down into the housing 38 from a higher location to enable temporary depression of the cam 49 for the purpose of releasing the latching pin 47.

While the embodiment of the invention described herein has two latching pins 47 and the cam 49 has two notches 54 for engaging the pins, the apparatus may also be constructed with a single pin and notch or with additional pins and notches depending on the degree of resistance to unauthorized opening that is needed.

Figure 10:
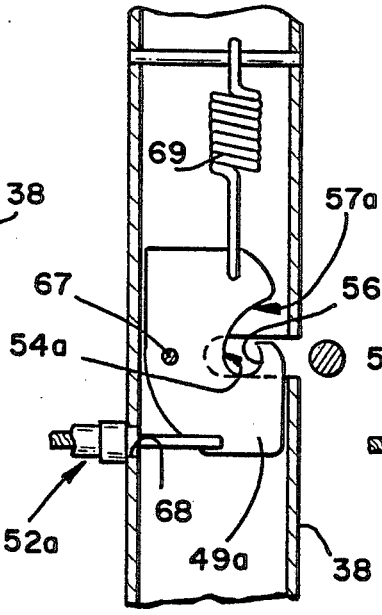
FIG. 10 is an elevation section view of a portion of grille latching mechanism in accordance with still another embodiment of the invention.
Figure 11:
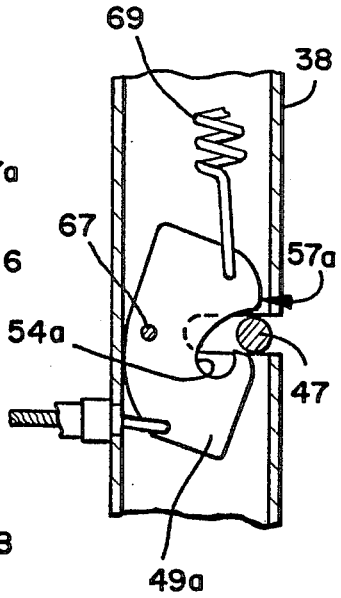
FIG. 11 is an elevation section view of the mechanism of FIG. 10 with components shown in a shifted position which occurs in the course of engagement and disengagement.

Referring now to FIGS. 10 and 11, embodiments of the invention are also possible in which the cam 49*a* or cams within the latching mechanism housing 38 are pivotable rather than slidable. Cam 49*a* in this example is mounted on a pivot axle 67 which extends transversely within housing 38 at the level of the latching pin 47 receiving slot 46 and has a pin engaging notch 54*a* generally similar to that previously described except that the second cam surface 57*a* defined by the upper margin of the notch has a convex curvature in order to urge the latching pin outwardly as the cam is turned to withdraw the first cam surface 56 from the slot 46. Turning of the cam 49*a* for this purpose is accomplished through an actuator cable 52*a* similar to that previously described except that it connects with the cam through an opening 68 in the side of the housing 38. The pivotable cam 49*a* is restored to the latching position and normally held at that position by a coil spring 69 within the housing 38.

Referring again to FIG. 1, the grille 11 may also be mounted outside window 12 at the exterior of the building as the latching mechanism is protected from tampering by channel member 44 as hereinbefore described. In such cases, actuator cable 52 extends through the wall 21 to enable inside mounting of the latching mechanism control 59 as previously described.

Thus while the invention has bee described with respect to certain specific embodiments for purposes of example many variations and modifications of the structure are possible and it is not intended to limit the invention except as defined in the following claims.

I claim:

1. In a security grille for disposition at a window, door, or the like, the combination comprising:

at least first and second cross bars which extend in a horizontal direction and which are vertically spaced apart with said first bar being above said second bar, each of said first and second bars having a first end portion adjacent a first side region of said grille, at least said first end portions of aid firsts and second bars having a hollow tubular configuration defining internal passages in said cross bars, a vertically extending side member situated at said first side region of said grille, said side member having a hollow tubular configuration at least at an upper portion thereof and a lower portion thereof, means for fastening said side member to a wall or the like, comprising a releasable latch secured to said side wall or the like at a location which is behind said side member; said side member including a latch cover which extends between said side member and said wall or the like at each side of said latch when said side member is engaged by said latch; and first and second angle members each having a horizontally extending leg and a vertically extending leg, said horizontal legs of said first and second angle members being entered into said first end portions of said first and second cross bars respectively in telescoping relationship therewith, and said vertical legs of said first and second angle members being entered into said upper and lower portions of said side connector member in telescoping relationship therewith.

2. The security grille construction of claim 1 wherein said means for fastening said side member to a wall or the like includes at least one latching pin secured to said side member, a vertically extending hollow housing attached to said wall and having a vertically directed interior passage and a transverse slot which communicates with said interior passage and which is proportioned to receive said pin, a movable cam disposed within said housing for movement therein between first and second positions, said cam having a notch through which said pin extends when said pin is in said slot, said notch being defined in part by a first cam surface which extends vertically to hold said pin in said slot when said cam is at said first position thereof and which is withdrawn from said slot when said cam is at said second position thereof, said notch being further defined in part by a second cam surface proportioned and positioned to eject said pin from said slot as said cam is traveled from said first position thereof to said second position thereof, said cam surface being still further defined in part by a third cam surface which forms an inclined ramp extending into said slot in position to be urged downward by said pin as said pin enters said slot and said notch, and resilient means for biasing said cam towards said first position thereof.

3. The security grille construction of claim 2 wherein said cam is slidable along said interior passage of said housing between said first and second positions of said cam.

4. The security grille construction of claim 2 wherein said cam is pivotable within said housing between said first and second positions of said cam.

5. The security grille construction of claim 2 wherein said means for fastening said side member to a wall or the like includes a plurality of said latching pins secured to said side member at vertically spaced apart locations therealong, and wherein said housing has a plurality of said transverse slots each positioned to receive a separate one of said pins, and wherein said cam is slidable within said housing passage between said first and second positions of said cam and has a plurality of said notches being located to engage a separate one of said pins.

6. The security grille construction of claim 5 wherein said grille is pivotably secured to said wall or the like at the side thereof which is Opposite from said side member and wherein said housing has a substantially triangular cross sectional configuration with the base thereof being against said wall or the like, and wherein said side member includes a vertically extending channel with opposite wall portions extending along opposite sides of said housing and which substantially covers said housing when said pins are engaged by said notches of said cam, said pins being disposed within said channel and having opposite ends secured to said opposite wall portions thereof, further including a grille release lever pivotably secured to said wall or the like at a location spaced apart from said housing and side member, and a flexible wire interconnecting said lever and said cam for translating said cam to said second position thereof in response to pivoting of said lever.

* * * * *